US010065092B2

(12) United States Patent
Goji et al.

(10) Patent No.: US 10,065,092 B2
(45) **Date of Patent: *Sep. 4, 2018**

(54) GOLF CLUB GRIP, GOLF CLUB AND METHOD FOR PRODUCING GOLF CLUB GRIP

(71) Applicant: SUMITOMO RUBBER INDUSTRIES, LTD., Kobe-shi, Hyogo (JP)

(72) Inventors: Sho Goji, Kobe (JP); Chiemi Mikura, Kobe (JP); Kazuyoshi Shiga, Kobe (JP); Kuniyasu Horiuchi, Kobe (JP); Toshiyuki Tarao, Kobe (JP); Hidetaka Inoue, Kobe (JP); Hitoshi Oyama, Kobe (JP); Hiroshi Hasegawa, Kobe (JP)

(73) Assignee: SUMITOMO RUBBER INDUSTRIES, LTD., Kobe-shi, Hyogo (JP)

( * ) Notice: Subject to any disclaimer, the term of this patent is extended or adjusted under 35 U.S.C. 154(b) by 0 days.

This patent is subject to a terminal disclaimer.

(21) Appl. No.: 15/159,933

(22) Filed: May 20, 2016

(65) Prior Publication Data

US 2016/0339311 A1 Nov. 24, 2016

(30) Foreign Application Priority Data

May 22, 2015 (JP) ..... 2015-104821

(51) Int. Cl.

| | |
|---|---|
| ***A63B 53/14*** | (2015.01) |
| ***A63B 60/16*** | (2015.01) |
| *A63B 60/52* | (2015.01) |

(52) U.S. Cl.

CPC ..... *A63B 53/14* (2013.01); *A63B 60/16* (2015.10); *A63B 60/52* (2015.10); *A63B 2209/00* (2013.01)

(58) Field of Classification Search

CPC ..... A63B 53/14

See application file for complete search history.

(56) References Cited

U.S. PATENT DOCUMENTS

| | | | | |
|---|---|---|---|---|
| 4,819,939 A * | 4/1989 | Kobayashi | ..... | A63B 53/14 473/299 |
| 5,772,524 A * | 6/1998 | Huang | ..... | A63B 49/08 473/300 |
| 6,093,767 A * | 7/2000 | Davis | ..... | C08L 21/00 428/1.33 |

(Continued)

FOREIGN PATENT DOCUMENTS

| | | |
|---|---|---|
| JP | H11-347166 A | 12/1999 |
| JP | 3701220 B2 | 9/2005 |

*Primary Examiner* — Michael Dennis

(74) *Attorney, Agent, or Firm* — Birch, Stewart, Kolasch & Birch, LLP

(57) ABSTRACT

An object of the present invention is to provide a golf club grip having excellent adhesion between the grip body and the grip end thereof, and excellent durability. The present invention provides a golf club grip comprising a cylindrical grip body having a cylindrical inner layer and a cylindrical outer layer covering the cylindrical inner layer, and a grip end provided on an butt side end of the cylindrical grip body, wherein the cylindrical outer layer is interposed in at least a part of a space between a butt side end edge of the cylindrical inner layer and the grip end.

19 Claims, 5 Drawing Sheets

(56) References Cited

U.S. PATENT DOCUMENTS

| | | | | |
|---|---|---|---|---|
| 2002/0025423 | A1* | 2/2002 | Dreher | B29C 44/12<br>428/318.4 |
| 2009/0298607 | A1* | 12/2009 | Fujimoto | A63B 53/14<br>473/300 |
| 2011/0165958 | A1* | 7/2011 | Hachiro | A63B 53/14<br>473/300 |
| 2012/0277337 | A1* | 11/2012 | Kawata | C08J 3/24<br>521/150 |
| 2014/0378242 | A1* | 12/2014 | Chalifoux | A63B 53/14<br>473/299 |

* cited by examiner

GOLF CLUB GRIP, GOLF CLUB AND METHOD FOR PRODUCING GOLF CLUB GRIP

FIELD OF THE INVENTION

The present invention relates to a golf club grip and a method for producing the same.

DESCRIPTION OF THE RELATED ART

As a grip provided on a golf club, a grip made of a rubber is frequently utilized. As such a rubber grip, for example, Japanese Patent No. 3701220 B discloses a golf club grip formed by crosslinking a rubber composition, wherein the rubber composition contains an acrylonitrile-butadiene rubber having a glass transition point of −40° C. or more and −13° C. or less in a ratio of 45 mass % or more with respect to a total amount of a base polymer; a peak temperature of a loss coefficient curve of the grip is −29° C. or more and 0° C. or less, when measured with a viscoelastic spectrometer under conditions of initial strain of 10%, amplitude of ±2%, frequency of 10 Hz, start temperature of −100° C., end temperature of 100° C., temperature rising speed of 3° C./min, and a deformation mode of tension (refer to claim 4 of Japanese Patent No. 3701220 B).

A light weight grip has also been proposed. For example, Japanese Patent Publication No. H11-347166 A discloses a golf club grip composed of a surface layer formed from a solid rubber and an inner layer formed from a foamed rubber, wherein the grip is imparted a light weight by forming the inner layer from a foamed rubber obtained by adding and mixing an organic-solvent-containing copolymer of vinylidene chloride and acrylonitrile into an unvulcanized rubber formulation to obtain a material, and then vulcanization molding the material (refer to claim 2 of Japanese Patent Publication No. H11-347166 A).

SUMMARY OF THE INVENTION

The inventors of the present invention have filed a patent application regarding a golf club grip having a construction, for example, as shown in FIG. 12. This grip 1 comprises a grip body having a cylindrical inner layer 3 and a cylindrical outer layer 5 covering the cylindrical inner layer 3, and a grip end 7 provided on an end of the grip body. In light of prevention of abrasion and cracking of the grip, a material having high strength and good durability is preferably employed for the outer layer of the grip. In addition, the cylindrical outer layer and the grip end of the grip constitute the surface layer of the grip, and are formed from a same or similar material so as to unify the appearance and touch feeling thereof. On the other hand, in light of light weighting and cost reduction, a material different from the material for the cylindrical outer layer of the grip may be employed for the cylindrical inner layer of the grip. However, when the affinity between the cylindrical inner layer and the grip end is low, the adhesion between the grip body and the grip end decreases, and thus a problem that the durability of the grip is lowered arises.

The present invention has been achieved in view of the above circumstances, and an object of the present invention is to provide a golf club grip having excellent adhesion between the grip body and the grip end thereof, and excellent durability. Further, another object of the present invention is to provide a golf club grip with light weight.

The golf club grip according to the present invention that has solved the above problem comprises a cylindrical grip body having a cylindrical inner layer and a cylindrical outer layer covering the cylindrical inner layer, and a grip end provided on a butt side end of the cylindrical grip body, wherein the cylindrical outer layer is interposed in at least a part of a space between a butt side end edge of the cylindrical inner layer and the grip end. By having such a construction, even if the cylindrical inner layer and the grip end are formed from materials having low affinity to each other, the adhesion between the grip end and the grip body improves if the cylindrical outer layer and the grip end are formed from materials having high affinity to each other. As a result, falling off of the grip end from the grip body can be prevented over a long period of time, and thus the grip exhibits improved durability.

The present invention also provides a golf club comprising a shaft, a head provided on one end of the shaft, and a grip provided on another end of the shaft, wherein the grip is the golf club grip according to the present invention.

According to the present invention, a golf club grip having excellent adhesion between the grip body and the grip end thereof is obtained. Further, according to the present invention, a golf club grip with light weight is obtained.

DESCRIPTION OF THE PREFERRED EMBODIMENT

The golf club grip according to the present invention comprises a cylindrical grip body having a cylindrical inner layer and a cylindrical outer layer covering the cylindrical inner layer, and a grip end provided on a butt side end of the cylindrical grip body. Further, a butt side end part of the cylindrical outer layer is interposed in at least a part of a space between a butt side end edge of the cylindrical inner layer and the grip end. It is noted that, in a golf club and a golf club grip provided thereon, a butt side is a grip end side and means a back end side of the golf club, and a tip side means a front end side (a side on which a head is provided) of the golf club.

[Construction of Golf Club Grip]

Next, the construction of the golf club grip according to the present invention will be explained with reference to figures. However, the present invention is not limited to the embodiments shown in these figures.

Figure 1:
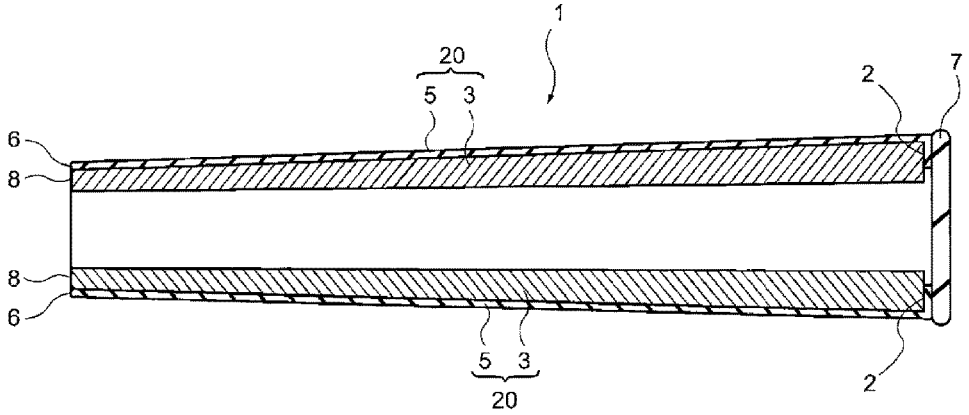
FIG. 1 is a schematic cross-sectional view showing one example of a golf club grip according to the present invention.

FIG. 1 is a schematic cross-sectional view showing one example of a golf club grip according to the present invention. A golf club grip 1 according to the present invention comprises a cylindrical grip body 20 having a cylindrical inner layer 3 and a cylindrical outer layer 5 covering the cylindrical inner layer 3, and a grip end 7 located on a butt side end of the cylindrical grip body 20. In the golf club grip 1 according to the present invention, the cylindrical outer layer 5 is interposed in at least a part of a space between a butt side end edge of the cylindrical inner layer 3 and the grip end 7. By having such a construction, even if the cylindrical inner layer 3 and the grip end 7 are formed from materials having low affinity to each other, the adhesion between the grip end 7 and the grip body 20 can be improved if the cylindrical outer layer 5 and the grip end 7 are formed from materials having high affinity to each other. Accordingly, falling off of the grip end 7 from the grip body 20 can be prevented over a long period of time. As a result, the material to be used for the cylindrical inner layer can be freely selected, and thus it is possible to reduce the weight of the grip while maintaining the durability of the grip.

Figure 2:
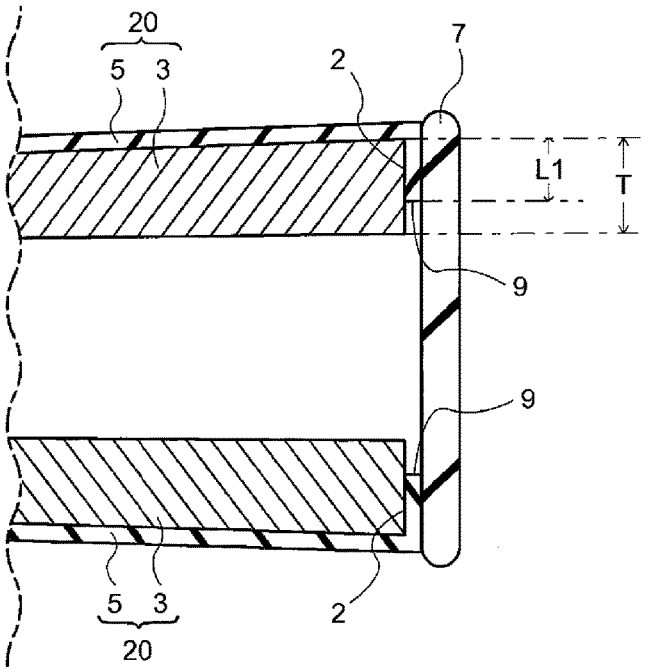
FIG. 2 is an enlarged view of the end part of the golf club grip on the grip end side in FIG. 1.

FIG. 2 is an enlarged view of the end part of the golf club grip on the grip end side in FIG. 1. The cylindrical outer layer 5 may cover at least a part of the butt side end edge 2 of the cylindrical inner layer 3. When a length (in the grip diameter direction) of the cylindrical outer layer 5 interposed between the butt side end edge 2 of the cylindrical inner layer 3 and the grip end 7 is L1, a ratio (L1/T) of the length L1 to a thickness T of the butt side end edge 2 of the cylindrical inner layer 3 is preferably 0.15 or more, more preferably 0.2 or more, even more preferably 0.5 or more, and most preferably 1. In FIG. 2, the length L1 is a distance from an outer end of the butt side end edge 2 of the cylindrical inner layer 3 to a butt side front end 9 of an outer layer sheet constituting the cylindrical outer layer. When the ratio is 1, the whole surface of the butt side end edge 2 of the cylindrical inner layer 3 is covered with the cylindrical outer layer 5. If the ratio is 0.15 or more, the adhesion between the grip end and the grip body is further enhanced, and thus the grip exhibits further enhanced durability. The cylindrical outer layer 5 interposed between the butt side end edge 2 of the cylindrical inner layer 3 and the grip end 7 is preferably continuous along the circumferential direction of the grip.

In the embodiment shown in FIG. 1, the cylindrical inner layer 3 and the cylindrical outer layer 5 constituting the grip body 20 almost have the same length in the axis direction, and a tip side end edge 8 of the cylindrical inner layer 3 and a tip side end edge 6 of the cylindrical outer layer 5 have the same position. In another preferable embodiment, the cylindrical inner layer 3 may be made longer than the cylindrical outer layer 5 on the tip side, or oppositely, the cylindrical outer layer 5 may be made longer than the cylindrical inner layer 3 on the tip side.

Figure 3:
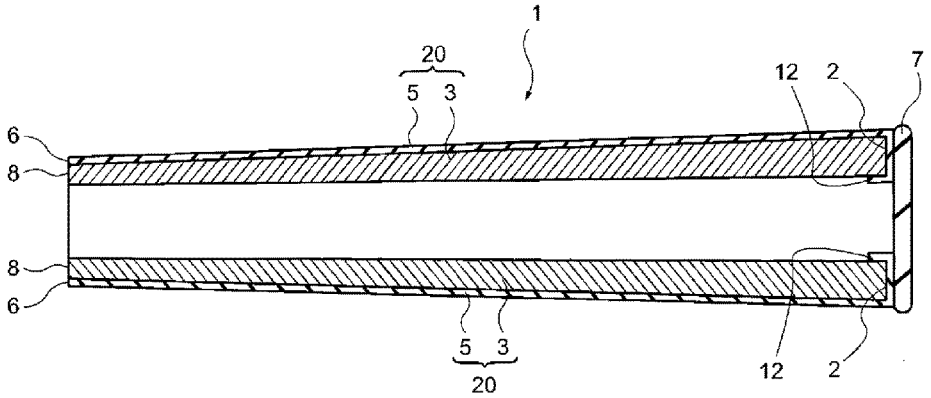
FIG. 3 is a schematic cross-sectional view showing another example of a golf club grip according to the present invention.

FIG. 3 is a schematic cross-sectional view showing another example of a golf club grip according to the present invention. As shown in FIG. 3, in the golf club grip 1 according to the present invention, the cylindrical outer layer 5 is preferably folded back to cover the butt side end edge 2 of the cylindrical inner layer and at least a part of a butt side inner surface of the cylindrical inner layer. By folding back the butt side end part of the cylindrical outer layer 5 to cover the butt side inner surface of the cylindrical inner layer, the butt side end edge 2 of the cylindrical inner layer 3 can be surely covered with the cylindrical outer layer 5, and thus the grip exhibits further enhanced durability.

Figure 4:
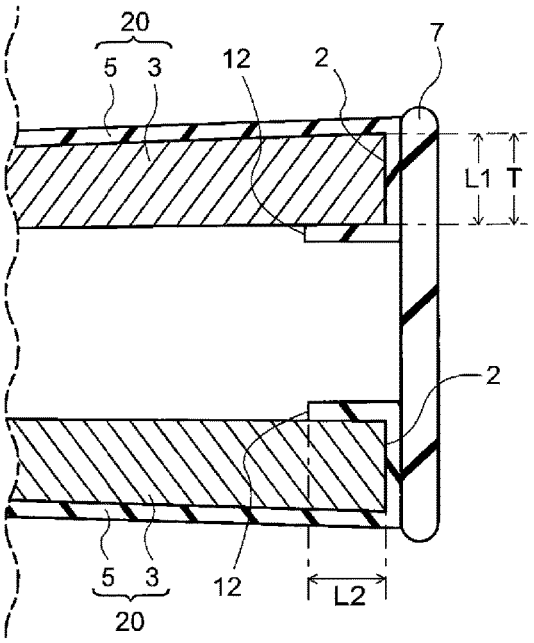
FIG. 4 is an enlarged view of the end part of the golf club grip on the grip end side in FIG. 3.

FIG. 4 is an enlarged view of the end part of the golf club grip on the grip end side in FIG. 3. The length L2 is a length where the outer layer sheet constituting the outer layer covers the butt side inner surface of the cylindrical inner layer 3 in the grip axis direction. The length L2 is preferably 0.5 mm or more, more preferably 1.5 mm or more, even more preferably 2.5 mm or more, and is preferably 14.5 mm or less, more preferably 6.5 mm or less, from the butt side end edge 2 of the cylindrical inner layer 3. If the length L2 is 0.5 mm or more, the end edge 2 of the cylindrical inner layer 3 on the butt side can be surely covered with the cylindrical outer layer 5, and thus the grip exhibits further enhanced durability. In addition, if the length L2 is 14.5 mm or less, in the case that the cylindrical inner layer 3 is a foamed layer, crushing of the foam can be suppressed. The length L2 is a distance from the end edge 2 of the cylindrical inner layer 3 on the butt side to a front end 12 of the folded back outer layer.

Figure 5:
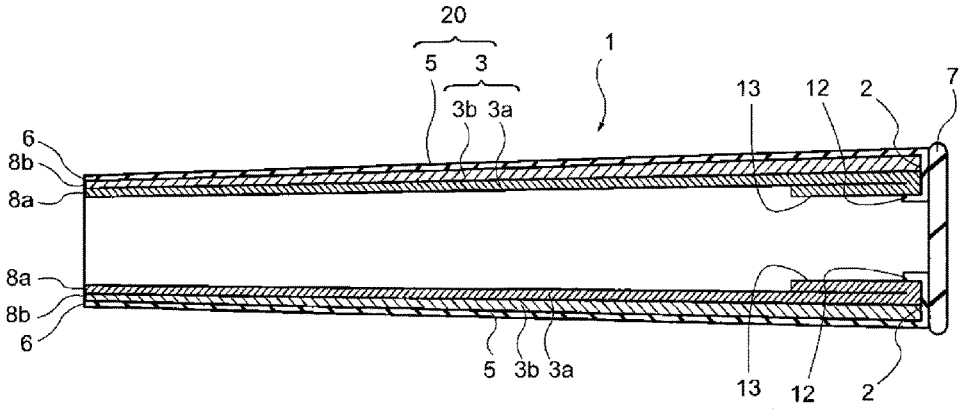
FIG. 5 is a schematic cross-sectional view showing another example of a golf club grip according to the present invention.

In the golf club grip, the cylindrical inner layer and the cylindrical outer layer may comprise at least one layer. The cylindrical inner layer may be a dual-layered structure. FIG. 5 is a schematic cross-sectional view showing another example of a golf club grip according to the present invention. In the embodiment shown in FIG. 5, the cylindrical inner layer 3 has a first inner layer 3*a* and a second inner layer 3*b* covering the outer side of the first inner layer 3*a*. The first inner layer 3*a* is preferably folded back at the butt side end part thereof.

Figure 6:
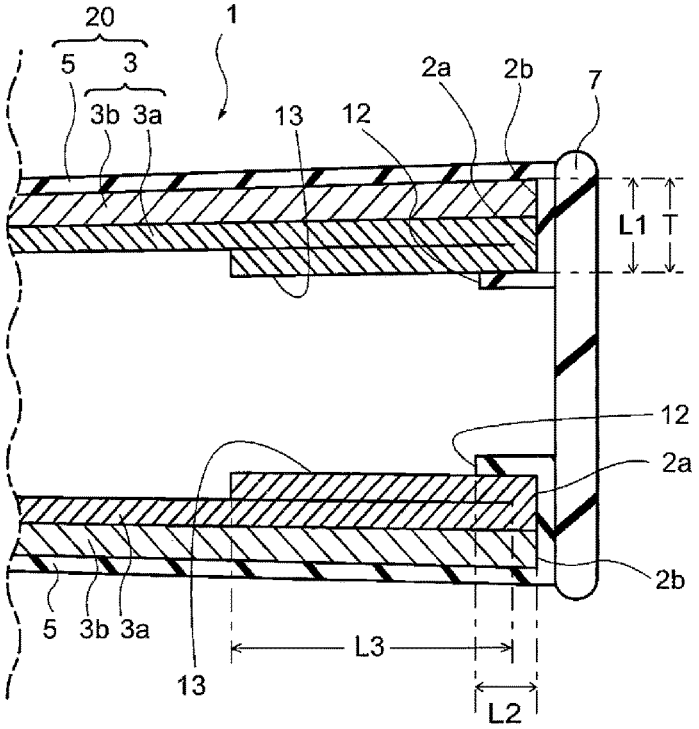
FIG. 6 is an enlarged view of the end part of the golf club grip on the grip end side in FIG. 5.

FIG. 6 is an enlarged view of the end part of the golf club grip on the grip end side in FIG. 5. The folded back part 13 of the first inner layer 3*a* has a length L3 of preferably 3 mm or more, more preferably 5 mm or more, and has a length L3 of preferably 10 mm or less, more preferably 7 mm or less, from the butt side end edge 2*a* of the first inner layer 3*a*. By folding back the first inner layer 3*a*, the grip end side can be thickened. In FIG. 6, the cylindrical outer layer 5 covers the butt side inner surface of the first inner layer 3*a*, however, the cylindrical outer layer 5 may not cover the inner surface of the first inner layer 3*a*. In addition, in FIG. 6, the cylindrical outer layer 5 covers the whole surface of the end edges (2*a*, 2*b*) of the first inner layer 3*a* and the second inner layer 3*b* on the butt side, however, for example, the cylindrical outer layer 5 may cover the whole end edge (2*b*) of the second inner layer 3*b* on the butt side and at least a part of the end edge (2*a*) of the first inner layer 3*a* on the butt side, or alternatively, the cylindrical outer layer 5 may cover at least a part of the end edge (2*b*) of the second inner layer 3*b* on the butt side.

Figure 7:
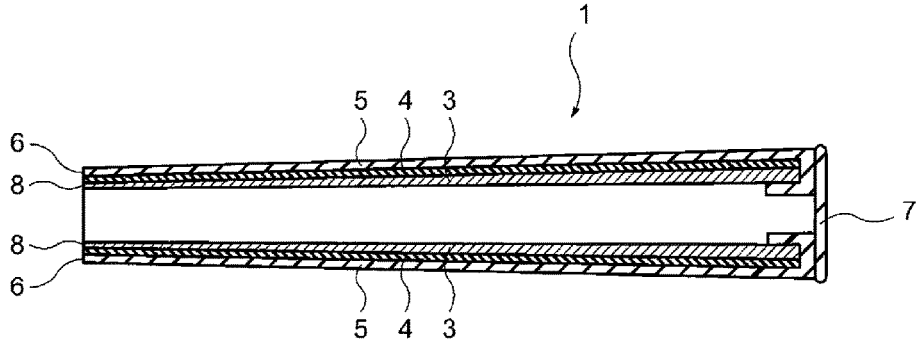
FIG. 7 is a schematic cross-sectional view showing another example of a golf club grip according to the present invention.

FIG. 7 is a modified example of a golf club grip according to the present invention. In FIG. 7, an adhesive layer 4 is provided between the cylindrical inner layer 3 and the cylindrical outer layer 5. By providing the adhesive layer 4, even if the cylindrical inner layer 3 and the cylindrical outer layer 5 are formed from materials having low affinity to each other, they can be firmly adhered together. In addition, the adhesive layer may also be provided between the end edge 2 of the cylindrical inner layer 3 on the butt side and the cylindrical outer layer 5. It is noted that the adhesive layer may be provided between the second inner layer 3*b* and the cylindrical outer layer 5 in the embodiment shown in FIG. 5.

In the above golf club grip, the cylindrical outer layer 5 is preferably folded back inwardly at the end part thereof on the tip side. In other words, the grip 1 preferably has, at the end part thereof on the tip side, a folded back part formed by folding back the cylindrical outer layer 5 inwardly. In the case that the cylindrical inner layer and the cylindrical outer layer are formed from materials different from each other, a difference between the tensile strength of the cylindrical inner layer and the tensile strength of the cylindrical outer layer arises, and thus the opening of the golf club grip on the tip side sometimes deforms to an elliptical shape. However, by having the folded back part at the end part of the golf club grip on the tip side, the tip side end part of the golf club grip can keep a circular shape.

Figure 8:
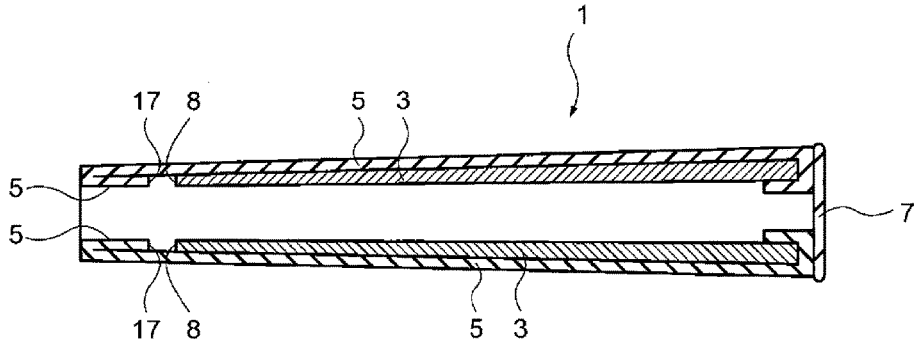
FIG. 8 is a schematic cross-sectional view showing another example of a golf club grip according to the present invention.
Figure 9:
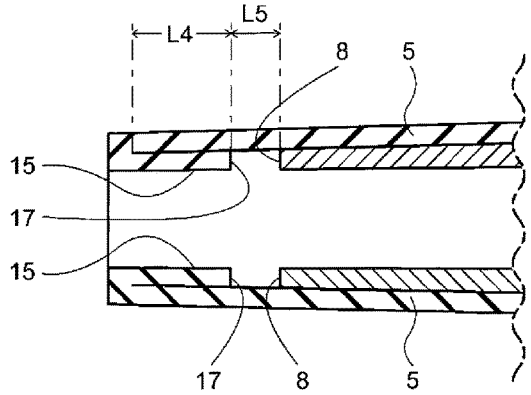
FIG. 9 is an enlarged view of the end part of the golf club grip on the tip side in FIG. 8.

FIG. 8 is a schematic cross-sectional view showing an embodiment of a golf club grip according to the present invention where the cylindrical outer layer is folded back inwardly at the end part thereof on the tip side. FIG. 9 is an enlarged view of the end part of the golf club grip on the tip side in FIG. 8. A length (a length in the grip axis direction) L4 of the folded back part 15 is preferably 4 mm or more, more preferably 6 mm or more, and is preferably 30 mm or less, more preferably 15 mm or less. It is preferred that, in the golf club grip, the folded back part 15 of the cylindrical outer layer 5 and the cylindrical inner layer 3 do not overlap. In other words, it is preferred that the tip side end part of the grip is formed from only the folded back part 15 of the cylindrical outer layer 5. If the tip side end part of the grip is formed from only the folded back part of the cylindrical outer layer, the mechanical strength of the tip side end part of the grip is enhanced. Accordingly, when installing the grip on a shaft, the breakage of the tip side end part of the grip is prevented.

In FIG. 9, a gap is formed between an end edge 17 of the folded back part 15 (a front end part of the folded back outer layer) and a tip side end edge 8 of the cylindrical inner layer 3. However, the end edge of the folded back part and the tip side end edge of the cylindrical inner layer are preferably in contact with each other. If the end edge of the folded back part and the tip side end edge of the cylindrical inner layer are in contact with each other, occurrence of a void where the inner layer and the outer layer are not present can be prevented in the molded grip. It is noted that a gap may be formed between the end edge 17 of the folded back part 15 and the tip side end edge 8 of the cylindrical inner layer 3, and in this case, a distance L5 between the end edge 17 and the end edge 8 is preferably 1 mm or less.

Figure 10:
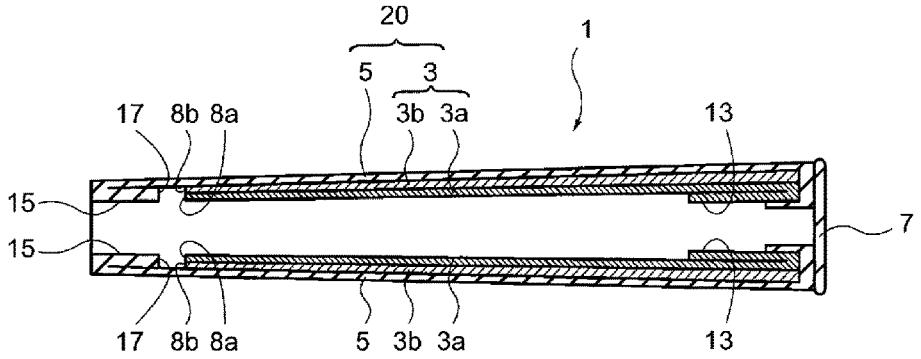
FIG. 10 is a schematic cross-sectional view showing another example of a golf club grip according to the present invention.

FIG. 10 is a schematic cross-sectional view showing another example of the golf club grip according to the embodiment shown in FIG. 5. In FIG. 10, the cylindrical outer layer 5 is folded back inwardly at the end part thereof on the tip side. In FIG. 10, the end edge 17 of the folded back part 15 (a front end part of the folded back outer layer) and the end edge 8 (8*a*, 8*b*) of the cylindrical inner layer 3 on the tip side are preferably in contact with each other. If the end edge of the folded back part and the tip side end edge of the cylindrical inner layer are in contact with each other, occurrence of a void where the inner layer and the outer layer are not present can be prevented in the molded grip. In FIG. 10, the tip side end edge 8*a* of the cylindrical inner layer and the tip side end edge 8*b* of the cylindrical inner layer have the same position. However, for example, the cylindrical inner layer 3*a* may be made longer than the cylindrical inner layer 3*b* on the tip side, or oppositely, the cylindrical inner layer 3*b* may be made longer than the cylindrical inner layer 3*a* on the tip side.

In the golf club grip according to the present invention, the cylindrical inner layer and the cylindrical outer layer may be a solid layer (a non-porous layer) or a porous layer. The porous layer is a layer including many fine pores (voids) being formed in a rubber or resin that is a base material. As the porous layer, a foamed layer or a micro-foamed layer is preferred.

Examples of the embodiment of the golf club grip include: (1) a combination of a solid inner layer and a porous outer layer, (2) a combination of a solid inner layer and a solid outer layer, (3) a combination of a porous inner layer and a porous outer layer, and (4) a combination of a porous inner layer and a solid outer layer. In light of a good balance between the light weight and strength of the golf club grip, it is preferred that the cylindrical inner layer is a porous layer and the cylindrical outer layer is a solid layer.

When the cylindrical inner layer is a porous layer, the density (Din) of the cylindrical inner layer is preferably 0.25 g/cm$^3$ or more, more preferably 0.27 g/cm$^3$ or more, even more preferably 0.29 g/cm$^3$ or more, and is preferably 0.40 g/cm$^3$ or less, more preferably 0.38 g/cm$^3$ or less, even more preferably 0.36 g/cm$^3$ or less. If the density of the cylindrical inner layer is 0.25 g/cm$^3$ or more, the cylindrical inner layer does not excessively deform and thus a steady hitting feeling can be obtained, and if the density of the cylindrical inner layer is 0.40 g/cm$^3$ or less, the light weighting effect of the grip brought by the porous layer becomes large.

When the cylindrical outer layer is a porous layer, the density (Dout) of the cylindrical outer layer is preferably 0.6 g/cm$^3$ or more, more preferably 0.65 g/cm$^3$ or more, even more preferably 0.7 g/cm$^3$ or more, and is preferably 1.1 g/cm$^3$ or less, more preferably 1.05 g/cm$^3$ or less, even more preferably 1.0 g/cm$^3$ or less. If the density of the cylindrical outer layer is 0.6 g/cm$^3$ or more, the cylindrical outer layer shows better abrasion resistance, and if the density of the cylindrical outer layer is 1.1 g/cm$^3$ or less, the light weighting effect of the grip brought by the porous layer becomes large.

When the cylindrical inner layer and the cylindrical outer layer are both porous layers, a density ratio (Dout/Din) thereof is preferably 1.6 or more, more preferably 1.8 or more, even more preferably 2.0 or more, and is preferably 4.5 or less, more preferably 4.3 or less, even more preferably 4.0 or less.

The cylindrical part constituting the grip body of the golf club grip according to the present invention may be formed with a fixed thickness along the axis direction thereof, or may be formed with a thickness gradually becoming thicker from the front end part (tip side) toward the back end part (butt side). In addition, the cylindrical part may be formed with a fixed thickness in the diameter direction thereof, or a projecting strip part (so-called back line) may be formed on a part of the cylindrical part. Furthermore, a groove may be formed on the surface of the cylindrical part. Formation of a water film between the hand of the golfer and the grip may be suppressed by the groove, and thus grip performance in a wet condition is further enhanced. In addition, in view of anti-slip performance and abrasion resistance of the grip, a reinforcing cord may be disposed in the grip.

The thickness of the cylindrical part constituting the grip body of the golf club grip according to the present invention is preferably 0.5 mm or more, more preferably 1.0 mm or more, even more preferably 1.5 mm or more, and is preferably 17.0 mm or less, more preferably 10.0 mm or less, even more preferably 8.0 mm or less. The thickness of the cylindrical part may be formed with a fixed thickness along the axis direction thereof or may be formed with a thickness gradually becoming thicker from the front end part toward the back end part.

The thickness of the outer layer and the inner layer may be uniform or varied. For example, the outer layer and the inner layer may be formed with a thickness gradually becoming thicker from one end toward another end along the axis direction of the cylindrical grip. The outer layer preferably has a uniform thickness.

When the cylindrical part has a thickness in a range from 0.5 mm to 17.0 mm, the thickness of the cylindrical outer layer is preferably 0.1 mm or more, more preferably 0.15 mm or more, even more preferably 0.2 mm or more, and is preferably 2.5 mm or less, more preferably 2.0 mm or less, even more preferably 1.5 mm or less, most preferably 0.7 mm or less. If the thickness of the cylindrical outer layer is 0.1 mm or more, the reinforcement effect brought by the outer layer material becomes large, and if the thickness of the cylindrical outer layer is 2.5 mm or less, the inner layer can be relatively thickened, and thus the light weighting effect of the grip becomes large.

A percentage ((thickness of cylindrical outer layer/thickness of cylindrical part)×100) of the thickness of the cylindrical outer layer to the thickness of the cylindrical part is preferably 0.5% or more, more preferably 1.0% or more, even more preferably 1.5% or more, and is preferably 99.0% or less, more preferably 98.0% or less, even more preferably 97.0% or less. If the above percentage is 0.5% or more, the reinforcement effect brought by the outer layer material becomes larger, and if the above percentage is 99.0% or less, the inner layer can be relatively thickened, and thus the light weighting effect of the grip becomes large.

The golf club grip according to the present invention has a grip end on the butt side end of the grip body. The shape of the grip end is not particularly limited, and examples thereof include a frustum shape, a hemisphere shape and a disc shape. Among them, the grip end preferably has a disc shape. The diameter of the grip end having a disc shape is preferably 25 mm or more, more preferably 27 mm or more, and is preferably 31 mm or less, more preferably 29 mm or less. In addition, the thickness of the grip end having a disc shape is preferably 3 mm or more, more preferably 4 mm or more, and is preferably 6 mm or less, more preferably 5 mm or less.

[Material of Golf Club Grip]

Next, the materials used for the golf club grip according to the present invention will be explained. The materials used for the golf club grip according to the present invention are not particularly limited, as long as the golf club grip has the above-described construction. In the golf club grip according to the present invention, the cylindrical outer layer and the grip end are preferably formed from materials having high affinity to each other. This is because if the cylindrical outer layer and the grip end are formed from materials having high affinity to each other, the adhesion between the grip body and the grip end is enhanced. Specifically, the composition used for the cylindrical outer layer and the composition used for the grip end preferably contain the same base rubber. Further, the cylindrical outer layer and the grip end are also preferably formed from the same composition.

[Cylindrical Outer Layer and Grip End]

The cylindrical outer layer and the grip end of the golf club grip according to the present invention are preferably formed from a first rubber composition containing an acrylonitrile-butadiene based rubber as a base rubber. If the outer layer contains the acrylonitrile-butadiene based rubber, the grip exhibits enhanced tensile strength and better grip performance in a wet condition.

Examples of the acrylonitrile-butadiene based rubber include an acrylonitrile-butadiene rubber (NBR), a carboxyl-modified acrylonitrile-butadiene rubber (XNBR), a hydrogenated acrylonitrile-butadiene rubber (HNBR), and a carboxyl-modified hydrogenated acrylonitrile-butadiene rubber (HXNBR). XNBR is a copolymer of a monomer having a carboxyl group, acrylonitrile and butadiene. HNBR is a hydrogenated product of the acrylonitrile-butadiene rubber. HXNBR is a hydrogenated copolymer of a monomer having a carboxyl group, acrylonitrile and butadiene.

The first rubber composition may further contain a rubber other than the acrylonitrile-butadiene based rubber as the base rubber. The amount of the acrylonitrile-butadiene based rubber in the base rubber is preferably 50 mass % or more, more preferably 60 mass % or more, even more preferably 70 mass % or more. In addition, it is also preferred that the first rubber composition contains only the acrylonitrile-butadiene based rubber as the base rubber.

In NBR, XNBR, HNBR and HXNBR, the amount of acrylonitrile is preferably 15 mass % or more, more preferably 18 mass % or more, even more preferably 21 mass % or more, and is preferably 50 mass % or less, more preferably 45 mass % or less, even more preferably 40 mass % or less. If the amount of acrylonitrile is 15 mass % or more, the grip shows better abrasion resistance, and if the amount of acrylonitrile is 50 mass % or less, the grip shows better touch feeling in a cold region or in winter.

In HNBR and HXNBR, the amount of a double bond is preferably 0.09 mmol/g or more, more preferably 0.2 mmol/g or more, and is preferably 2.5 mmol/g or less, more preferably 2.0 mmol/g or less, even more preferably 1.5 mmol/g or less. If the amount of the double bond is 0.09 mmol/g or more, vulcanization is easily carried out during molding and the grip shows enhanced tensile strength, and if the amount of the double bond is 2.5 mmol/g or less, the grip shows better durability (weather resistance) and tensile strength. The amount of the double bond can be adjusted by the amount of butadiene in the copolymer or the amount of hydrogen added to the copolymer.

Examples of the monomer having a carboxyl group in XNBR and HXNBR include acrylic acid, methacrylic acid, fumaric acid, and maleic acid. In XNBR and HXNBR, the amount of the monomer having a carboxyl group is preferably 1.0 mass % or more, more preferably 2.0 mass % or more, even more preferably 3.5 mass % or more, and is preferably 30 mass % or less, more preferably 25 mass % or less, even more preferably 20 mass % or less. If the amount of the monomer having a carboxyl group is 1.0 mass % or more, the grip shows better abrasion resistance, and if the amount of the monomer having a carboxyl group is 30 mass % or less, the grip shows better touch feeling in a cold region or in winter.

In XNBR and HXNBR, the content of the carboxyl group is preferably 1.0 mass % or more, more preferably 2.0 mass % or more, even more preferably 3.5 mass % or more, and is preferably 30 mass % or less, more preferably 25 mass % or less, even more preferably 20 mass % or less. If the content of the carboxyl group is 1.0 mass % or more, the grip shows better abrasion resistance, and if the content of the carboxyl group is 30 mass % or less, the grip shows better touch feeling in a cold region or winter.

The first rubber composition preferably contains a crosslinking agent in addition to the base rubber. As the crosslinking agent, a sulfur crosslinking agent and an organic peroxide can be used. Examples of the sulfur crosslinking agent include an elemental sulfur and a sulfur donor type compound. Examples of the elemental sulfur include powdery sulfur, precipitated sulfur, colloidal sulfur, and insoluble sulfur. Examples of the sulfur donor type compound include 4,4'-dithiobismorpholine. Examples of the organic peroxide include dicumyl peroxide, α,α'-bis(t-butylperoxy-m-diisopropyl) benzene, 2,5-dimethyl-2,5-di(t-butylperoxy) hexane, and 1,1-bis(t-butylperoxy)-3,3,5-trimethylcyclohexane. The crosslinking agent may be used solely, or two or more of them may be used in combination. As the crosslinking agent, the sulfur crosslinking agent is preferred, and the elemental sulfur is more preferred. The amount of the crosslinking agent is preferably 0.2 part by mass or more, more preferably 0.4 part by mass or more, even more preferably 0.6 part by mass or more, and is preferably 4.0 parts by mass or less, more preferably 3.5 parts by mass or less, even more preferably 3.0 parts by mass or less, with respect to 100 parts by mass of the base rubber.

The first rubber composition preferably further contains a vulcanization accelerator or a vulcanization activator. Examples of the vulcanization accelerator include thiurams such as tetramethylthiuram disulfide (TMTD), tetrabenzylthiuram disulfide (TBzTD), tetramethylthirammonosulfide (TMTM), and dipentamethylenethiuram tetrasulfide; guanidines such as diphenylguanidine (DPG); dithiocarbamates such as zinc dimethyldithiocarbamate (ZnPDC), and zinc dibutyldithiocarbamate; thioureas such as trimethylthiourea, and N,N'-diethylthiourea; thiazoles such as mercaptobenzothiazole (MBT), and benzothiazole disulfide; sulfenamides such as N-cyclohexyl-2-benzothiazolylsulfenamide (CBS), and N-t-butyl-2-benzothiazolylsulfenamide (BBS); and the like. These vulcanization accelerators may be used solely, or two or more of them may be used in combination. The amount of the vulcanization accelerator is preferably 0.4 part by mass or more, more preferably 0.8 part by mass or more, even more preferably 1.2 parts by mass or more, and is preferably 8.0 parts by mass or less, more preferably 7.0 parts by mass or less, even more preferably 6.0 parts by mass or less, with respect to 100 parts by mass of the base rubber.

Examples of the vulcanization activator include a metal oxide, a metal peroxide, and a fatty acid. Examples of the metal oxide include zinc oxide, magnesium oxide, and lead oxide. Examples of the metal peroxide include zinc peroxide, chromium peroxide, magnesium peroxide, and calcium peroxide. Examples of the fatty acid include stearic acid, oleic acid, and palmitic acid. These vulcanization activators may be used solely, or two or more of them may be used in combination. The amount of the vulcanization activator is preferably 0.5 part by mass or more, more preferably 0.6 part by mass or more, even more preferably 01 part by mass or more, and is preferably 10.0 parts by mass or less, more preferably 9.5 parts by mass or less, even more preferably 9.0 parts by mass or less, with respect to 100 parts by mass of the base rubber.

The first rubber composition may further contain a reinforcing material, antioxidant, softening agent, coloring agent, antiscorching agent, and the like where necessary.

Examples of the reinforcing material include carbon black and silica. The amount of the reinforcing material is preferably 2.0 parts by mass or more, more preferably 3.0 parts by mass or more, even more preferably 4.0 parts by mass or more, and is preferably 50 parts by mass or less, more preferably 45 parts by mass or less, even more preferably 40 parts by mass or less, with respect to 100 parts by mass of the base rubber.

Examples of the antioxidant include imidazoles, amines, phenols and thioureas. Examples of the imidazoles include nickel dibutyldithiocarbamate (NDIBC), 2-mercaptobenzimidazole, and zinc salt of 2-mercaptobenzimidazole. Examples of the amines include phenyl-α-naphtylamine. Examples of the phenols include 2,2'-methylene bis(4-methyl-6-t-butylphenol) (MBMBP), and 2,6-di-tert-butyl-4-methylphenol. Examples of the thioureas include tributyl thiourea, and 1,3-bis(dimethylaminopropyl)-2-thiourea. These antioxidants may be used solely, or two or more of them may be used in combination. The amount of the antioxidant is preferably 0.2 part by mass or more, more preferably 0.3 part by mass or more, even more preferably 0.4 part by mass or more, and is preferably 5.0 parts by mass or less, more preferably 4.8 parts by mass or less, even more preferably 4.6 parts by mass or less, with respect to 100 parts by mass of the base rubber.

Examples of the softening agent include a mineral oil and a plasticizer. Examples of the mineral oil include paraffin oil, naphthene oil, and aromatic oil. Examples of the plasticizer include dioctyl phthalate, dibutyl phthalate, dioctyl sebacate, and dioctyl adipate.

Examples of the antiscorching agent include an organic acid and a nitroso compound. Examples of the organic acid include phthalic anhydride, pyromellitic anhydride, trimellitic anhydride, benzoic acid, salicylic acid, and malic acid. Examples of the nitroso compound include N-nitrosodiphenylamine, N-(cyclohexylthio)phthalimide, sulfonamide derivative, diphenyl urea, bis(tridecyl)pentaerythritol diphosphite, and 2-mercaptobenzimidazole.

The first rubber composition can be prepared by a conventionally known method, for example, by mixing and kneading raw materials using a kneading machine such as Banbury mixer, kneader, and open roll. The temperature (material temperature) performing mixing and kneading preferably ranges from 70° C. to 160° C. In addition, when the composition contains microballoons which will be described later, mixing and kneading are preferably performed at a temperature lower than the expansion starting temperature of the microballoons.

The material hardness (JIS-A) of the first rubber composition is preferably 30 or more, more preferably 40 or more, even more preferably 45 or more, and is preferably 80 or less, more preferably 70 or less, even more preferably 60 or less. If the material hardness (JIS-A) of the first rubber composition is 30 or more, the cylindrical outer layer shows further enhanced mechanical strength, and if the material hardness (JIS-A) of the first rubber composition is 80 or less, the cylindrical outer layer does not become excessively hard and thus the grip feeling when holding the grip becomes better.

The tensile strength of the first rubber composition is preferably 1.0 MPa or more, more preferably 1.2 MPa or more, even more preferably 1.3 MPa or more, and is preferably 3.0 MPa or less, more preferably 2.5 MPa or less, even more preferably 2.0 MPa or less.

The cylindrical outer layer may be a solid layer or a porous layer, and is preferably a solid layer. If the cylindrical outer layer is a solid layer, the grip has further enhanced mechanical strength. If the cylindrical outer layer is a porous layer, the golf club grip has further reduced weight.

Examples of the method producing the porous layer include a balloon foaming method, chemical foaming method, supercritical carbon dioxide injection molding method, salt extraction method, and solvent removing method. In the balloon foaming method, microballoons are allowed to be contained in the rubber composition, and then be expanded by heating to perform foaming. In addition, the expanded microballoons may be blended in the rubber composition, and then the resultant rubber composition is molded. In the chemical foaming method, a foaming agent (such as azodicarbonamide, azobisisobutyronitrile, N,N'-dinitrosopentamethylenetetramine, p-toluenesulfonyl hydrazine, and p-oxybis(benzenesulfonyl hydrazide)) and a foaming aid are allowed to be contained in the rubber composition, and then a gas (such as carbon dioxide gas and nitrogen gas) is generated by a chemical reaction to perform foaming. In the supercritical carbon dioxide injection molding method, the rubber composition is immersed in carbon dioxide being in a supercritical state at a high pressure, the resultant rubber composition is injected at a normal pressure, and carbon dioxide is gasified to perform foaming. In the salt extraction method, a soluble salt (such as boric acid and calcium chloride) is allowed to be contained in the rubber composition, and then the salt is dissolved and extracted after molding to form fine pores. In the solvent removing method, a solvent is allowed to be contained in the rubber composition, and then the solvent is removed after molding to form fine pores.

When the cylindrical outer layer is a porous layer, a foamed layer formed from the first rubber composition containing the acrylonitrile-butadiene based rubber and a foaming agent is preferred. In particular, a foamed layer formed by the balloon foaming method is preferred. In other words, the cylindrical outer layer is preferably a foamed layer formed from the first rubber composition containing microballoons. If microballoons are used, the cylindrical outer layer has a light weight while maintaining the mechanical strength thereof. As the microballoons, organic microballoons or inorganic microballoons may be used. Examples of the organic microballoons include hollow particles formed from a thermoplastic resin, and resin capsules encapsulating a hydrocarbon having a low boiling point in a shell formed from a thermoplastic resin. Specific examples of the resin capsules include Expancel (registered trademark) manufactured by Akzo Nobel Company, and Matsumoto Microsphere (registered trademark) manufactured by Matsumoto Yushi Seiyaku Co., Ltd. Examples of the inorganic microballoons include hollow glass particles (such as silica balloons and alumina balloons), and hollow ceramic particles.

The volume average particle diameter of the resin capsules (before expansion) is preferably 5 μm or more, more preferably 6 μm or more, even more preferably 9 μm or more, and is preferably 90 μm or less, more preferably 70 μm or less, even more preferably 60 μm or less.

When the cylindrical outer layer is formed by the balloon foaming method, the amount of microballoons in the first rubber composition is preferably 1.0 part by mass or more, more preferably 1.2 parts by mass or more, even more preferably 1.5 parts by mass or more, and is preferably 10 parts by mass or less, more preferably 8 parts by mass or less, even more preferably 6 parts by mass or less, with respect to 100 parts by mass of the base rubber. If the amount of microballoons is 1.0 part by mass or more, foaming can be performed more uniformly at the time of forming the porous layer, and if the amount of microballoons is 10 parts by mass or less, the porous layer strikes a good balance between light weight and mechanical strength.

The foaming ratio of the cylindrical outer layer formed by the balloon foaming method is preferably 1.1 or more, more preferably 1.2 or more, and is preferably 2.0 or less, more preferably 1.8 or less, even more preferably 1.5 or less. If the foaming ratio is 1.1 or more, the grip shows a greater effect of reducing weight, and if the foaming ratio is 2.0 or less, lowering in the mechanical strength of the cylindrical outer layer can be suppressed.

[Cylindrical Inner Layer]

The cylindrical inner layer is preferably formed from an inner layer composition containing a base rubber or a base resin. Examples of the base rubber include a natural rubber (NR), ethylene-propylene-diene rubber (EPDM), butyl rubber (IIR), acrylonitrile-butadiene rubber (NBR), hydrogenated acrylonitrile-butadiene rubber (HNBR), carboxyl-modified acrylonitrile-butadiene rubber (XNBR), butadiene rubber (BR), styrene-butadiene rubber (SBR), polyurethane rubber (PU), isoprene rubber (IR), chloroprene rubber (CR), and ethylene-propylene rubber (EPM). Among them, NR, EPDM, IIR, NBR, HNBR, XNBR, BR, SBR, and PU are preferred as the base rubber.

Examples of the base resin include a polyurethane resin, polystyrene resin, polyethylene resin, polypropylene resin, ethylene-vinyl acetate copolymer resin, and polyethylene terephthalate resin.

The inner layer composition (hereinafter sometimes referred to as "second rubber composition") containing a base rubber preferably further contains a crosslinking agent. Examples of the crosslinking agent include the same ones as those employed in the first rubber composition, and the elemental sulfur is preferred. The second rubber composition preferably further contains a vulcanization accelerator and a vulcanization activator. Examples of these vulcanization accelerator and vulcanization activator include the same ones as those employed in the first rubber composition. As the vulcanization accelerator, N-t-butyl-2-benzothiazolylsulfenamide and tetrabenzylthiuram disulfide are preferred. As the vulcanization activator, zinc oxide and stearic acid are preferred.

The second rubber composition may further contain a reinforcing material, antioxidant, softening agent, coloring agent, antiscorching agent, and the like where necessary. Examples of these reinforcing material, antioxidant and coloring agent include the same ones as those employed in the first rubber composition. As the reinforcing material, carbon black and silica are preferred. As the antioxidant, 2,2'-methylene bis(4-methyl-6-t-butylphenol) is preferred.

When the cylindrical inner layer is a foamed layer, the inner layer composition preferably contains a foaming agent. The cylindrical inner layer is more preferably a foamed layer formed by the balloon foaming method. In other words, the cylindrical inner layer is preferably a foamed layer formed from the inner layer composition containing microballoons. If microballoons are used, the cylindrical inner layer has a light weight while maintaining the mechanical strength thereof. Examples of the microballoons include the same ones as those employed in the first rubber composition, and the resin capsules encapsulating a hydrocarbon having a low boiling point in a shell formed from a thermoplastic resin are preferred.

When the cylindrical inner layer is formed by the balloon foaming method, the amount of microballoons in the inner layer composition is preferably 5 parts by mass or more, more preferably 8 parts by mass or more, even more preferably 12 parts by mass or more, and is preferably 20 parts by mass or less, more preferably 18 parts by mass or less, even more preferably 15 parts by mass or less, with respect to 100 parts by mass of the base material (base rubber or base resin). If the amount of microballoons is 5 parts by mass or more, the grip shows a greater effect of reducing weight, and if the amount of microballoons is 20 parts by mass or less, lowering in the mechanical strength of the cylindrical inner layer can be suppressed.

The foaming ratio of the cylindrical inner layer formed by the balloon foaming method is preferably 1.2 or more, more preferably 1.5 or more, even more preferably 1.8 or more, and is preferably 5.0 or less, more preferably 4.5 or less, even more preferably 4.0 or less. If the foaming ratio is 1.2 or more, the grip shows a greater effect of reducing weight, and if the foaming ratio is 5.0 or less, lowering in the mechanical strength of the cylindrical inner layer can be suppressed.

The inner layer composition can be prepared by a conventionally known method, for example, by mixing and kneading raw materials using a kneading machine such as Banbury mixer, kneader, and open roll. The temperature (material temperature) performing mixing and kneading preferably ranges from 70° C. to 160° C. In addition, when the inner layer composition contains microballoons, mixing and kneading are preferably performed at a temperature lower than the expansion starting temperature of the microballoons.

The material hardness (JIS-A) of the inner layer composition (second rubber composition or inner layer resin composition) is preferably 10 or more, more preferably 15 or more, even more preferably 20 or more, and is preferably 80 or less, more preferably 70 or less, even more preferably 60 or less. If the material hardness (JIS-A) of the inner layer composition is 10 or more, the cylindrical inner layer does not become excessively soft and thus a tightly fixed touch feeling can be obtained when holding the grip, and if the material hardness (JIS-A) of the inner layer composition is 80 or less, the cylindrical inner layer does not become excessively hard and thus the grip feeling when holding the grip becomes better.

The material hardness $H_{out}$ (JIS-A) of the first rubber composition is preferably same as or larger than the material hardness $H_{in}$ (JIS-A) of the inner layer composition. In this case, the hardness difference ($H_{out}$–$H_{in}$) (JIS-A) is preferably 0 or more, more preferably 10 or more, even more preferably 20 or more, and is preferably 65 or less, more preferably 60 or less, even more preferably 55 or less. If the hardness difference ($H_{out}$–$H_{in}$) falls within the above range, the grip feeling when holding the grip becomes better.

The tensile strength of the inner layer composition is preferably 0.1 MPa or more, more preferably 0.2 MPa or more, even more preferably 0.3 MPa or more, and is preferably 1.1 MPa or less, more preferably 1.0 MPa or less, even more preferably 0.9 MPa or less. A ratio of the tensile strength of the first rubber composition to the tensile strength of the inner layer composition (first rubber composition/inner layer composition) is preferably 1.0 or more, more preferably 1.5 or more, even more preferably 2.0 or more, and is preferably 20 or less, more preferably 10 or less, even more preferably 5 or less.

In the golf club grip according to the present invention, when the cylindrical outer layer and the cylindrical inner layer are both foamed layers, it is preferred that the foaming ratio of the cylindrical outer layer is lower than the foaming ratio of the cylindrical inner layer. Further, in this case, a ratio of the foaming ratio of the cylindrical inner layer to the foaming ratio of the cylindrical outer layer (inner layer/outer layer) is preferably 1.1 or more, more preferably 1.5 or more, even more preferably 2.0 or more, and is preferably 10.0 or less, more preferably 9.0 or less, even more preferably 8.0 or less.

[Adhesive Layer]

The golf club grip may further comprise an adhesive layer between the layers of the cylindrical inner layer and cylindrical outer layer. It is noted that the adhesive layer is preferably a very thin layer having a thickness of about 30 μm or less. Examples of the adhesive constituting the adhesive layer include a vulcanization adhesive (crosslinking adhesive) and a rubber glue. If the adhesive layer is comprised, the peeling strength between the cylindrical inner layer and cylindrical outer layer increases.

The adhesive composition for forming the adhesive layer preferably contains an olefin based rubber. Examples of the olefin based rubber include an ethylene-propylene rubber (EPM), ethylene-propylene-diene rubber (EPDM), butyl rubber (IIR), chlorosulfonated polyethylene (CSM), maleic acid modified ethylene-propylene rubber (M-EPM), and chlorinated polyethylene rubber (CM). The content of the olefin based rubber in the rubber component contained in the adhesive composition is preferably 50 mass % or more.

The olefin based rubber is preferably a modified olefin based rubber. Examples of the modified olefin based rubber include the chlorosulfonated polyethylene (CSM), maleic acid modified ethylene-propylene rubber (M-EPM), and chlorinated polyethylene rubber (CM).

The content of the modified polyethylene in the modified olefin based rubber is preferably 5 mass % or more, more preferably 7 mass % or more, even more preferably 10 mass % or more, and is preferably 15 mass % or less, more preferably 12 mass % or less, even more preferably 10 mass % or less. If the content of the modified polyethylene is 5 mass % or more, the peeling strength between the inner layer and the outer layer is further enhanced, and if the content of the modified polyethylene is 15 mass % or less, lowering in the tensile strength of the grip is suppressed.

In particular, the olefin based rubber is preferably the chlorosulfonated polyethylene. The chlorosulfonated polyethylene is obtained by chlorosulfonating polyethylene, and is represented by the following chemical formula (I).

[Chemical formula 1]

(1)

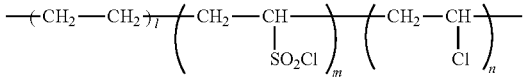

[In the formula, l, m and n represent a ratio (mass %) of each repeated unit, respectively.]

Specific examples of the olefin based rubber include Chemlok 6108, XJ-150, Chemlok 233X, Chemlok 402X, and Chemlok 8216 available from Lord Far East Inc.

The adhesive composition preferably contains 4,4'-diphenyl methane diisocyanate (MDI). If MDI is contained, the peeling strength between the inner layer and the outer layer is further enhanced. The content of MDI is preferably more than 0 mass %, more preferably 1 mass % or more, even more preferably 2 mass % or more, and is preferably 6 mass % or less, more preferably 5 mass % or less, even more preferably 4 mass % or less.

The adhesive composition may contain a solvent. If a solvent is contained, a thinner adhesive layer can be formed, and thus the grip exhibits further enhanced tensile strength.

Examples of the solvent include an organic solvent such as xylene and toluene. In the case that the solvent is contained, the concentration of the solid component (concentration of the component other than the solvent) in the adhesive composition is preferably in a range from 10 mass % to 30 mass %. Further, the adhesive composition may contain a filler (carbon black, silica or the like).

[Production Method]

The golf club grip according to the present invention can be obtained, for example, by press molding a laminated product and a grip end in a mold, wherein the laminated product comprises an unvulcanized rubber sheet formed from the first rubber composition and an unvulcanized rubber sheet formed from the second rubber composition or a resin sheet formed from the inner layer resin composition, and the grip end is formed from the first rubber composition. As the method of forming the sheet from the first rubber composition or the inner layer composition, press molding or injection molding may be employed. In addition, the grip end may be in any state of an unvulcanized state, half-vulcanized state and completely-vulcanized state. When the laminated product is press molded, the temperature of the mold preferably ranges from 140° C. to 200° C., the molding time preferably ranges from 5 minutes to 45 minutes, and the molding pressure preferably ranges from 0.1 MPa to 150 MPa. In addition, when the foaming layer is formed by the balloon foaming method, it is preferred that balloons are not expanded when producing the outer sheet and inner sheet, and balloons are expanded when press molding the laminated product of the outer sheet and inner sheet.

The production method of the golf club grip preferably comprises: a step of preparing a first rubber composition and an inner layer composition (composition preparation step), a step of forming an inner layer sheet from the inner layer composition (inner layer sheet formation step), a step of forming an unvulcanized outer layer sheet from the first rubber composition (outer layer sheet formation step), a step of forming a grip end from the first rubber composition (grip end formation step), a step of laminating the inner layer sheet and the outer layer sheet to form a laminated product (lamination step), a step of folding back a butt side end part of the outer layer sheet toward an inner layer sheet side to cover a butt side end edge of the inner layer sheet with the outer layer (folding back step), and a step of press molding the laminated product comprising the outer layer sheet having the butt side end part thereof folded back, and the grip end in a mold (molding step).

In the composition preparation step, the first rubber composition and the inner layer composition can be prepared by the above-described method, for example, by kneading raw materials using a kneading machine such as Banbury mixer, a kneader, and an open roll. It is noted that when the composition contains microballoons, the material temperature at the time of kneading is preferably lower than the expansion starting temperature of the microballoons.

In the inner layer sheet formation step, the method of forming the inner layer sheet from the inner layer composition is not particularly limited, and a conventionally known method may be employed. In the case that the inner layer composition is a rubber composition, an unvulcanized inner layer sheet is formed. The inner layer composition preferably contains microballoons. In this case, in the inner layer sheet formation step, the material temperature at the time of molding is preferably lower than the expansion starting temperature of the microballoons.

In the outer layer sheet formation step, the method of forming the unvulcanized outer layer sheet from the first rubber composition is not particularly limited, and a conventionally known method may be employed.

In the grip end formation step, the method of forming the grip end from the first rubber composition is not particularly limited, and a conventionally known method may be employed. It is noted that the grip end may be in any state of an unvulcanized state, half-vulcanized state and completely-vulcanized state.

In the lamination step, the inner layer sheet and the outer layer sheet may be laminated in a sheet state. Alternatively, the inner layer sheet and the outer layer sheet may be laminated by winding the inner layer sheet around a mandrel followed by winding the outer layer sheet around the circumference of this inner layer.

In the folding back step, the butt side end part of the outer layer sheet is folded back toward the inner layer sheet side to cover the butt side end edge of the inner layer sheet with the outer layer sheet. By covering the butt side end edge of the inner layer sheet with the outer layer sheet, the outer layer sheet is interposed between the butt side end edge of the inner layer sheet and the grip end. Since the outer layer sheet and the grip end are both formed from the first rubber composition, they show high affinity to each other. As a result, the obtained grip has high adhesion between the grip end and the laminated product (grip body) composed of the inner layer and the outer layer thereof, thereby exhibiting excellent durability.

A folded back length (a length in the grip axis direction) L0 of the butt side end part of the outer layer sheet is preferably 2 mm or more, more preferably 4 mm or more, and is preferably 16 mm or less, more preferably 8 mm or less, from the butt side end edge of the outer layer sheet. It is noted that the folded back length L0 is a distance from the end edge of the outer layer sheet on the butt side to the folding back line.

In addition, in the case that the inner layer composition contains microballoons, the folded back length L0 of the cylindrical outer layer on the butt side is preferably adjusted according to a thickness of the butt side end part of the cylindrical inner layer after foaming. Specifically, a ratio (length L0/thickness T of inner layer) of the length L0 (*mm*) to the thickness T (mm) of the butt side end part of the cylindrical inner layer after foaming is preferably 0.2 or more, more preferably 0.5 or more, even more preferably 0.7 or more, and is preferably 3.3 or less, more preferably 2.0 or less, even more preferably 1.3 or less. If the above ratio is 0.2 or more, the outer layer sheet can be reliably interposed between the butt side end edge of the inner layer sheet and the grip end even if the inner layer is foamed. In addition, if the above ratio is 3.3 or less, hindrance of the foaming of the butt side end part of the inner layer by the folded back outer sheet can be prevented.

In addition, it is also preferred that the folding back step further comprises a step of folding back a tip side end part of the outer layer sheet toward an inner layer sheet side to form a folded back part. By having the folded back part at the tip side end part of the grip, the outer layer hardly deforms at the tip side end part of the grip. As a result, at the time of foaming the inner layer, the inner layer near the tip side end part of the grip can be uniformly foamed. Accordingly, the shape of the tip side end part of the grip can be prevented from being deformed to an elliptical shape at the time of foaming the inner layer.

A folded back length (a length in the grip axis direction) L4 of the tip side end part of the outer layer sheet is preferably 4 mm or more, more preferably 6 mm or more, and is preferably 30 mm or less, more preferably 15 mm or less, from the end edge of the outer layer sheet on the tip side. It is noted that the folded back length L4 is a distance from the end edge of the outer layer sheet on the tip side to the folding back line.

In the molding step, the laminated product is heated and vulcanized. The molding method is not particularly limited, and a conventionally known method may be employed. It is noted that when the inner layer composition contains microballoons, the material temperature at the time of press molding is preferably equal to or higher than the expansion starting temperature of the microballoons.

[Golf Club]

A golf club using the above-described golf club grip is also included in the present invention. The golf club comprises a shaft, a head provided on one end of the shaft, and a grip provided on another end of the shaft, wherein the grip is the above-described golf club grip. The shaft can be made of stainless steel or a carbon fiber reinforced resin. Examples of the head include a wood type, utility type, and iron type. The material constituting the head is not particularly limited, and examples thereof include titanium, a titanium alloy, a carbon fiber reinforced plastic, stainless steel, maraging steel, and soft iron.

Figure 11:
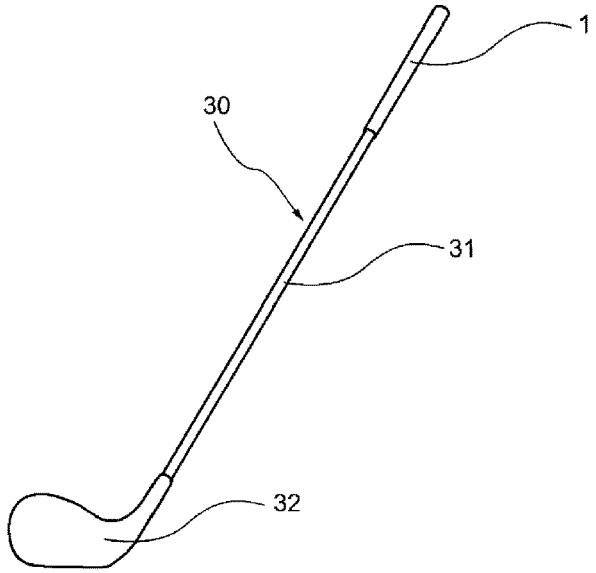
FIG. 11 is a perspective view showing one example of a golf club grip.
Figure 12:
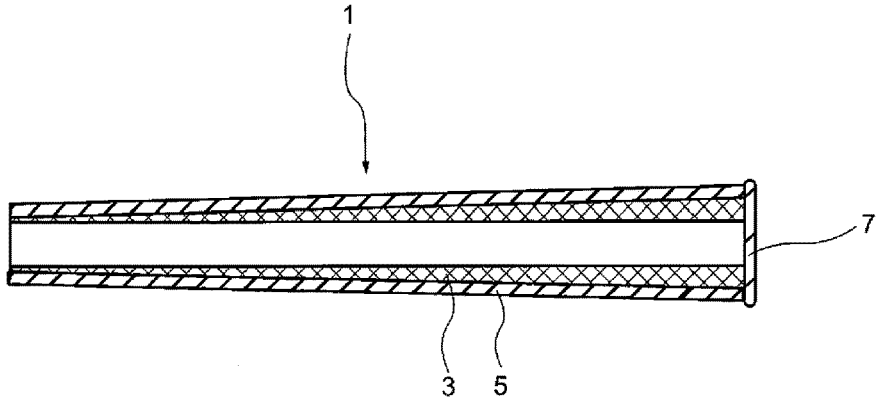
FIG. 12 is a schematic cross-sectional view showing one example of a golf club grip.

FIG. 11 is a perspective view showing one example of a golf club according to the present invention. A golf club 30 comprises a shaft 31, a head 32 provided on one end of the shaft, and a grip 1 provided on another end of the shaft. The back end of the shaft 31 is inserted into the cylindrical part of the grip 1.

EXAMPLES

Hereinafter, the present invention will be described in detail by way of examples. However, the present invention is not limited to the examples described below, and various changes and modifications can be made in accordance with the spirit of the present invention and are included in the technical scope of the present invention.

[Evaluation Method]

(1) Amount of Acrylonitrile

The amount of acrylonitrile in the acrylonitrile-butadiene rubber before hydrogenation was measured according to ISO 24698-1 (2008).

(2) Amount of Double Bond (mmol/g)

The amount of the double bond was calculated from the amount (mass %) of butadiene in the copolymer and the amount (%) of a residual double bond. The amount of the residual double bond is a mass ratio (amount of double bond after hydrogenation/amount of double bond before hydrogenation) of the double bond in the copolymer after hydrogenation to the double bond in the copolymer before hydrogenation, and can be measured by infrared spectroscopy. In the case that the acrylonitrile-butadiene rubber is an acrylonitrile-butadiene binary copolymer, the amount of butadiene in the copolymer was calculated by subtracting the amount (mass %) of acrylonitrile from 100.

$$\text{Amount of double bond}=\{\text{amount of butadiene}/54\}\times\text{amount of residual double bond}\times 10$$

(3) Amount of Monomer Having Carboxyl Group 1 g of the hydrogenated acrylonitrile-butadiene rubber was weighed and dissolved in 50 ml of chloroform, a thymol blue indicator was dripped therein. 0.05 mol/L sodium hydroxide methanol solution was dripped into the solution while the solution was stirred, and the dripping amount (V ml) at the time the solution color initially changed was recorded. Regarding a blank, i.e. 50 ml of chloroform not containing the hydrogenated acrylonitrile-butadiene rubber, thymol blue was used as an indicator, 0.05 mol/L sodium hydroxide methanol solution was dripped into the solution, and the dripping amount (B ml) at the time the solution color initially changed was recorded. The amount of the monomer having the carboxyl group was calculated according to the following formula.

$$\text{Amount of monomer having carboxyl group}=\{0.05\times(V-B)\times PM\}/(10\times X)$$

(In the formula, V: dripping amount (ml) of sodium hydroxide solution in test solution, B: dripping amount (ml) of sodium hydroxide solution in blank, PM: molecular weight of monomer having carboxyl group, X: valence of monomer having carboxyl group.)

(4) Material Hardness (JIS-A)

Sheets with a thickness of 2 mm were formed by pressing the rubber composition at 160° C. for 8 to 20 minutes. It is noted that, in the case that the rubber composition contains microballoons, the sheets were formed by expanding microballoons at the same foaming ratio as that when forming the grip. These sheets were stored at 23° C. for two weeks. Three of these sheets were stacked on one another so as not to be affected by the measuring base on which the sheets were placed, and the stack was measured with a type P1 auto loading durometer manufactured by Kobunshi Keiki Co., Ltd., provided with a type A durometer prescribed in JIS K6253-3 (2012).

(5) Foaming Ratio

A measurement sample, i.e. the foaming layer was cut from the grip, and the density (d1) of the foaming layer was measured. Further, an unfoamed rubber sheet was produced from the rubber composition used for forming this foaming layer, and the density (d2) of the rubber sheet was measured. The foaming ratio (d2/d1) was calculated by dividing the density of the unfoamed sheet by the density of the foamed layer. It is noted that the density was measured with an auto gravimeter (SP-GR1 manufactured by MS-TEC Co. Ltd., based on Archimedes' principle).

(6) Tensile Strength

The tensile strength was measured according to JIS K 6251 (2010). A sheet with a thickness of 2 mm was formed by pressing the rubber composition at 160° C. for 8 to 20 minutes, and the sheet was punched into a dumbbell shape (Dumbbell shape No. 3) to prepare a test piece. It is noted that, in the case that the rubber composition contains microballoons, the sheet was formed by expanding microballoons at the same foaming ratio as that when forming the grip. The physical properties of each test piece were measured (measurement temperature: 23° C., tensile speed: 500 mm/min) using a tensile test measurement apparatus (Autograph AGS-D manufactured by SHIMADZU Corporation). Then, the tensile strength was calculated by dividing the ultimate tensile force recorded until the test piece was broken by the initial cross-sectional area of the test piece.

(7) Mass

The mass of each grip was measured. It is noted that the mass of Grip No. 1 was defined as an index of 100, and the mass of each grip is shown as a value obtained by converting the mass of each grip into this index.

(8) Ellipticity

The seam diameter and pole diameter of the opening of the molded golf club grip on the tip side were measured respectively, and the ellipticity was calculated according to the following formula. An ellipticity closer to 0 means that the shape of the opening of the golf club grip on the tip side is closer to a circular shape.

$$\text{Ellipticity}=\{1-(\text{pole diameter}/\text{seam diameter})\}\times 100$$

(9) Durability

A golf club provided with the grip thereon was prepared. An actual hitting was performed for 20,000 times by using the golf club, and durability of the grip was evaluated according to the following evaluation criterion. The case where the grip was undamaged even if the actual hitting was performed for 20,000 times was graded as "E (excellent)", the case where the grip was undamaged when the actual hitting was performed for 10,000 times while damaged when the actual hitting was performed for 20,000 times was graded as "G (good)", and the case where the grip was damaged when the actual hitting was performed for 10,000 times was graded as "P (poor)".

[Production of Grip]

According to the formulations shown in Table 1, raw materials were mixed and kneaded with Banbury mixer (material temperature: 80° C. to 150° C.) to prepare first rubber compositions and second rubber compositions.

[Production of Golf Club Grip]

An unvulcanized outer layer rubber sheet having a fan shape was prepared from the first rubber composition. It is noted that the outer layer rubber sheet was formed with a fixed thickness. In addition, a grip end (unvulcanized) having a disc shape with a thickness of 4 mm and a diameter of 28 mm was formed from the first rubber composition. Unvulcanized inner layer (first inner layer and second inner layer) rubber sheets having a rectangular shape were prepared from the second rubber composition. It is noted that the inner layer rubber sheet was formed with a thickness gradually becoming thicker from one end toward another end.

The first inner layer rubber sheet was wound around a mandrel, and the butt side end part thereof was folded back by a length of 5 mm. Then, the second inner layer rubber sheet was laminated and wound around thereon. An adhesive, i.e. Chemlok (registered trademark) 6108 or 8216 available from Lord Far East Inc. was applied to the second

TABLE 1

| | | | | Rubber composition No. | |
|---|---|---|---|---|---|
| | | | | 1 | 2 |
| Formulation (parts by mass) | Base rubber | Nonpolar rubber | NR | 70 | — |
| | | | EPDM | 30 | — |
| | | Polar rubber | HXNBR | — | 100 |
| | Crosslinking agent | Sulfur | Sulfur powder | 2 | 1.5 |
| | Vulcanization accelerator | CBS | NOCCELER CZ | 1 | — |
| | | BBS | NOCCELER NS | 1 | — |
| | | DPG | SOXINOL D (DPG) | 1 | — |
| | | TBzTD | NOCCELER TBzTD | — | 3 |
| | Vulcanization activator | Zinc oxide | WHITE SEAL | 3 | — |
| | | Zinc peroxide | Struktol ZP 1014 | — | 5 |
| | | Fatty acid | Stearic acid | 1 | 2 |
| | Reinforcing material | Silica | ULTRASIL VN3 | 8 | — |
| | | Carbon black | DIABLACK N220 | 4 | — |
| | | | SEAST SO (FEF) | — | 5 |
| | Antioxidant | MBMBP | NOCRAC NS-6 | 0.5 | — |
| | | NiBDC | NOCRAC NBC | — | 1.5 |
| | Vulcanization retardant | CTPI | SANTOGARD PVI | 0.3 | — |
| | | Aromatic fatty acid | Benzoic acid | 0.5 | — |
| | Softening agent | Mineral oil | Diana Process Oil PA32 | 2 | — |
| | Foaming agent | Microballoons | Expancel 909-80DU | 20 | — |
| | Material hardness (JIS-A) | | | 54 | 56 |
| | Tensile strength (MPa) | | | 0.57 | 1.92 |

Materials used in Table 1 are shown below.

NR (natural rubber): TSR 20

EPDM (ethylene-propylene-diene rubber): ESPRENE (registered trademark) 505 A manufactured by Sumitomo Chemical Co., Ltd.

HXNBR: hydrogenated carboxyl-modified acrylonitrile-butadiene rubber (Therban XT VPKA 8889 (amount of residual double bond: 3.5%, amount of acrylonitrile: 33.0 mass %, amount of monomer having carboxyl group: 5.0 mass %, amount of double bond: 0.40 mmol/g) manufactured by Lanxess Corporation)

Sulfur: 5% oil treated sulfur fine powder (200 mesh) manufactured by Tsurumi Chemical Industry Co., Ltd.

NOCCELER CZ: N-cyclohexyl-2-benzothiazolylsulfenamide manufactured by Ouchi Shinko Chemical Industry Co., Ltd.

NOCCELER NS: N-t-butyl-2-benzothiazolylsulfenamide manufactured by Ouchi Shinko Chemical Industry Co., Ltd.

SOXINOL D: 1,3-diphenylguanidine manufactured by Sumitomo Chemical Co., Ltd.

NOCCELER TBzTD: tetrabenzylthiuram disulfide manufactured by Ouchi Shinko Chemical Industry Co., Ltd.

Zinc oxide: White Seal manufactured by PT. Indo Lysaght Corporation

Zinc peroxide: Struktol ZP 1014 (content of zinc peroxide: 29 mass %) manufactured by Struktol Company Stearic acid: beads stearic acid camellia manufactured by NOF Co., Ltd.

Silica: ULTRASIL VN3 manufactured by EVONIK Industries

Carbon black (1): DIABLACK N220 manufactured by Mitsubishi Chemical Corporation

Carbon black (2): SEAST SO (FEF) manufactured by Tokai Carbon Co., Ltd.

MBMBP: 2,2'-methylene bis(4-methyl-6-t-butylphenol) (NOCRAC (registered trademark) NS-6 manufactured by Ouchi Shinko Chemical Industry Co., Ltd.)

NiBDC: nickel dibutyldithiocarbamate (NOCRAC NBC manufactured by Ouchi Shinko Chemical Industry Co., Ltd.)

SANTOGARD PVI: N-cyclohexylthiophthalimide manufactured by Sanshin Chemical Industry Co., Ltd.

Benzoic acid: manufactured by Sigma-Aldrich Corporation

Diana Process Oil PA32: manufactured by Idemitsu Kosan Co., Ltd.

Microballoons: "Expancel 909-80" (resin capsules encapsulating a hydrocarbon having a low boiling point in a shell formed from a thermoplastic resin,
volume average particle diameter: 18 μm to 24 μm, expansion starting temperature: 120° C. to 130° C.) manufactured by Akzo Nobel Company inner layer rubber sheet, and then the outer layer rubber sheet was laminated and wound around thereon. In Grips No. 2-8, the butt side end part of the outer layer rubber sheet was folded back and inserted between the mandrel and the first inner layer sheet. Further, the tip side end part of the outer layer rubber sheet was folded back toward the inner side.

Then, the grip end was attached to the butt side of the grip body to obtain unvulcanized grips. The unvulcanized grips were charged into a mold having a groove pattern on the cavity surface thereof. The unvulcanized grips were heated at a mold temperature of 160° C. for 15 minutes to obtain golf club grips. In the obtained golf club grips, the cylindrical portion had a thickness of 1.3 mm at the thinnest part (the end part on the head side), and a thickness of 6.0 mm at the end part of the cylindrical inner layer on the butt side. The cylindrical portion had a thickness of 6.7 mm at the thickest part (the end part on the grip end side) in Grips No. 1-4, and had a thickness of 7.3 mm at the thickest part (the end part on the grip end side) in Grips No. 5-9. In addition, the folded back part at the tip side end part of the cylindrical outer layer was not laminated on the cylindrical inner layer, and the front end part of the folded back outer layer on the tip side was in contact with the tip side end edge of the cylindrical inner layer.

Evaluation results for each of the grips are shown in Table 2.

TABLE 2

| | | | | Grip No. | | | | | | | | |
|---|---|---|---|---|---|---|---|---|---|---|---|---|
| | | | | 1 | 2 | 3 | 4 | 5 | 6 | 7 | 8 | 9 |
| Production conditions | Cylindrical inner layer | First inner layer | Rubber composition No. | 1 | 1 | 1 | 1 | 1 | 1 | 1 | 1 | 1 |
| | | Second inner layer | Rubber composition No. | 1 | 1 | 1 | 1 | 1 | 1 | 1 | 1 | 1 |
| | | Length of rubber sheet (mm) | | 262 | 262 | 262 | 262 | 262 | 262 | 262 | 262 | 262 |
| | Cylindrical outer layer | Rubber composition No. | | 2 | 2 | 2 | 2 | 2 | 2 | 2 | 2 | 2 |
| | | Length of rubber sheet (mm) | | 270 | 271 | 272 | 274 | 278 | 282 | 286 | 290 | 320 |
| | | Thickness of rubber sheet (mm) | | 0.6 | 0.6 | 0.6 | 0.6 | 0.6 | 0.6 | 0.6 | 0.6 | 0.6 |
| | | Length L0 of folded back part (mm) | | — | 1 | 2 | 4 | 8 | 12 | 16 | 20 | 50 |
| | | Ratio of length L0 (mm) to thickness T (mm) of end edge of inner layer on butt side after foaming | | 0.0 | 0.2 | 0.3 | 0.7 | 1.3 | 2.0 | 2.7 | 3.3 | 8.3 |
| | Grip end | Rubber composition No. | | 2 | 2 | 2 | 2 | 2 | 2 | 2 | 2 | 2 |
| Physical properties of grip | Cylindrical inner layer | First inner layer | Foaming ratio | 3.5 | 3.5 | 3.5 | 3.5 | 3.5 | 3.5 | 3.5 | 3.5 | 3.5 |
| | | Second inner layer | Foaming ratio | 3.5 | 3.5 | 3.5 | 3.5 | 3.5 | 3.5 | 3.5 | 3.5 | 3.5 |
| | | Length L3 of folded back part (mm) | | 5 | 5 | 5 | 5 | 5 | 5 | 5 | 5 | 5 |
| | | Thickness T (mm) of end edge on butt side | | 6 | 6 | 6 | 6 | 6 | 6 | 6 | 6 | 6 |
| | Cylindrical outer layer | Length L1 (mm) | | — | 1 | 2 | 4 | 6 | 6 | 6 | 6 | 6 |
| | | Length L2 (mm) | | — | 0 | 0 | 0 | 2 | 6 | 10 | 14 | 44 |
| | | Length L4 (mm) | | 4 | 4 | 4 | 4 | 4 | 4 | 4 | 4 | 4 |
| | | Ratio (length L1/thickness T) | | — | 0.2 | 0.3 | 0.7 | 1 | 1 | 1 | 1 | 1 |
| Evaluation | | Ellipticity of opening on tip side (%) | | 10 | 10 | 10 | 10 | 10 | 10 | 10 | 10 | 10 |
| | | Mass of grip | | 100 | 100 | 101 | 101 | 103 | 104 | 106 | 107 | 119 |
| | | Durability | | P | G | G | E | E | E | E | E | E |

Grip No. 1 is the case where a folded back part is not formed at the butt side end part of the cylindrical outer layer. This Grip No. 1 has low adhesion between the grip body and the grip end thereof, thereby showing inferior durability. Grips No. 2 to No. 9 are the cases where the butt side end part of the cylindrical outer layer is interposed in at least a part of the space between the butt side end edge of the cylindrical inner layer and the grip end. These Grips No. 2 to No. 9 have high adhesion between the grip body and the grip end thereof, thereby showing excellent durability. Among them, Grips No. 5 to No. 9 are the cases where the butt side end part of the cylindrical outer layer is folded back to cover the butt side end edge of the cylindrical inner layer and the inner surface of the cylindrical inner layer on the butt side, and accordingly have higher adhesion between the grip body and the grip end thereof, thereby showing further enhanced durability.

This application is based on Japanese patent application No. 2015-104821 filed on May 22, 2015, the content of which is hereby incorporated by reference.

The invention claimed is:

1. A golf club grip comprising a cylindrical grip body having a cylindrical inner layer and a cylindrical outer layer covering the cylindrical inner layer, and a grip end provided on a butt side end of the cylindrical grip body, wherein the cylindrical outer layer is formed from a rubber composition containing a carboxyl-modified acrylonitrile-butadiene rubber and/or a carboxyl-modified hydrogenated acrylonitrile-butadiene rubber as a base rubber, wherein the cylindrical inner layer is formed from a second rubber composition containing at least one rubber selected from the group consisting of a natural rubber, ethylene-propylene-diene rubber, butyl rubber, acrylonitrile-butadiene rubber, hydrogenated acrylonitrile-butadiene rubber, carboxyl-modified acrylonitrile-butadiene rubber, butadiene rubber, styrene-butadiene rubber, polyurethane rubber, isoprene rubber, chloroprene rubber, and ethylene-propylene rubber as a base rubber, wherein the grip end is formed from a first rubber composition containing an acrylonitrile-butadiene based rubber as a base rubber, wherein the cylindrical inner layer and the cylindrical outer layer almost have the same length in the axis direction, or the cylindrical outer layer is longer than the cylindrical inner layer on the tip side, wherein the cylindrical outer layer is interposed in a space between a butt side end edge of the cylindrical inner layer and the grip end, wherein a butt side end part of the cylindrical outer layer is folded back to cover the butt side end edge of the cylindrical inner layer and a butt side inner surface of the cylindrical inner layer, and wherein a length L2 is 0.5 mm or more and 14.5 mm or less, wherein L2 is a length where the cylindrical outer layer covers the butt side inner surface of the cylindrical inner layer in the grip axis direction.

2. The golf club grip according to claim 1, wherein the acrylonitrile-butadiene based rubber of the first rubber composition of the grip end is at least one selected from the group consisting of a carboxyl-modified acrylonitrile-butadiene rubber, a hydrogenated acrylonitrile-butadiene rubber, and a carboxyl-modified hydrogenated acrylonitrile-butadiene rubber.

3. The golf club grip according to claim 1, wherein the cylindrical inner layer is a porous rubber layer.

4. The golf club grip according to claim 3, wherein the porous rubber layer has a foaming ratio ranging from 1.2 to 5.0.

5. The golf club grip according to claim 1, wherein the cylindrical outer layer is a solid layer.

6. The golf club grip according to claim 1, wherein the golf club grip is obtained by press molding a laminated product and a grip end in a mold, and wherein the laminated product comprises an unvulcanized rubber sheet formed from the rubber composition containing a carboxyl-modified acrylonitrile-butadiene rubber and/or a carboxyl-modified hydrogenated acrylonitrile-butadiene rubber as a base rubber and an unvulcanized rubber sheet formed from the second rubber composition, and the grip end is formed from the first rubber composition.

7. The golf club grip according to claim 1, wherein the cylindrical inner layer is a foamed layer formed from the second rubber composition, wherein the second rubber composition contains the base rubber and microballoons, and wherein the amount of the microballoons in the second rubber composition is 5 parts by mass or more, and 20 parts by mass or less, with respect to 100 parts by mass of the base rubber.

8. The golf club grip according to claim 1, wherein the rubber composition used for the cylindrical outer layer and the first rubber composition used for the grip end contain the same base rubber.

9. The golf club grip according to claim 1, wherein the golf club grip has, at the end part thereof on the tip side, a folded back part formed by folding back the cylindrical outer layer inwardly.

10. The golf club grip according to claim 9, wherein a length in the grip axis direction L4 of the folded back part is 4 mm or more and 30 mm or less.

11. A golf club comprising:

a shaft, a head provided on one end of the shaft, and a grip provided on another end of the shaft, wherein the grip is a golf club grip comprising a cylindrical grip body having a cylindrical inner layer and a cylindrical outer layer covering the cylindrical inner layer, and a grip end is provided on a butt side end of the cylindrical grip body, wherein the cylindrical inner layer is formed from a second rubber composition containing at least rubber selected from the group consisting of a natural rubber, ethylene-propylene-diene rubber, butyl rubber, acrylonitrile-butadiene rubber, hydrogenated acrylonitrile-butadiene rubber, carboxyl-modified acrylonitrile-butadiene rubber, butadiene rubber, styrene-butadiene rubber, polyurethane rubber, isoprene rubber, chloroprene rubber, and ethylene-propylene rubber as a base rubber, wherein the grip end is formed from a first rubber composition containing an acrylonitrile-butadiene based rubber as a base rubber, wherein the cylindrical inner layer and the cylindrical outer layer almost have the same length in the axis direction, or the cylindrical outer layer is longer than the cylindrical inner layer on the tip side, wherein the cylindrical outer layer is interposed in a space between a butt side end edge of the cylindrical inner layer and the grip end, wherein a butt side end part of the cylindrical outer layer is folded back to cover the butt side end edge of the cylindrical inner layer and a butt side inner surface of the cylindrical inner layer, and wherein a length L2 is 0.5 mm or more and 14.5 mm or less, wherein L2 is a length where the cylindrical outer layer covers the butt side inner surface of the cylindrical inner layer in the grip axis direction.

12. The golf club according to claim 11, wherein the acrylonitrile-butadiene based rubber of the first rubber composition of the grip end is at least one selected from the group consisting of a carboxyl-modified acrylonitrile-butadiene rubber, a hydrogenated acrylonitrile-butadiene rubber, and a carboxyl-modified hydrogenated acrylonitrile-butadiene rubber.

13. The golf club according to claim 11, wherein the cylindrical inner layer is a porous rubber layer and the cylindrical outer layer is a solid layer.

14. The golf club according to claim 13, wherein the porous rubber layer has a foaming ratio ranging from 1.2 to 5.0.

15. The golf club according to claim 11, wherein the golf club grip is obtained by press molding a laminated product and a grip end in a mold, wherein the laminated product comprises an unvulcanized rubber sheet formed from the rubber composition containing a carboxyl-modified acrylonitrile-butadiene rubber and/or a carboxyl-modified hydrogenated acrylonitrile-butadiene rubber as a base rubber and an unvulcanized rubber sheet formed from the second rubber composition, and the grip end is formed from the first rubber composition.

16. The golf club according to claim 11, wherein the cylindrical inner layer is a foamed layer formed from the second rubber composition, wherein the second rubber composition contains the base rubber and microballoons, and wherein the amount of the microballoons in the second rubber composition is 5 parts by mass or more, and 20 parts by mass or less, with respect to 100 parts by mass of the base rubber.

17. The golf club according to claim 11, wherein the rubber composition used for the cylindrical outer layer and the first rubber composition used for the grip end contain the same base rubber.

18. The golf club according to claim 11, wherein the golf club grip has, at the end part thereof on the tip side, a folded back part formed by folding back the cylindrical outer layer inwardly.

19. The golf club according to claim 18, wherein a length in the grip axis direction L4 of the folded back part is 4 mm or more and 30 mm or less.

* * * * *